United States Patent [19]

Hays et al.

[11] 4,339,923

[45] Jul. 20, 1982

[54] SCOOP FOR REMOVING FLUID FROM ROTATING SURFACE OF TWO-PHASE REACTION TURBINE

[75] Inventors: Lance G. Hays, Los Angeles; William E. Amend, Rolling Hills Estates; Gustave J. Hokenson, Los Angeles, all of Calif.

[73] Assignee: Biphase Energy Systems, Santa Monica, Calif.

[21] Appl. No.: 136,255

[22] Filed: Apr. 1, 1980

[51] Int. Cl.[3] ..... F01K 25/06

[52] U.S. Cl. ..... 60/673; 60/649; 415/88; 416/197 R

[58] Field of Search ..... 60/649, 673, 694; 416/197 R, 243

[56] References Cited

U.S. PATENT DOCUMENTS

| | | | |
|---|---|---|---|
| 1,527,571 | 2/1925 | Morrison | 416/197 |
| 3,879,949 | 4/1975 | Hays et al. | 60/649 |
| 3,972,195 | 8/1976 | Hays et al. | 60/671 |
| 4,027,993 | 6/1977 | Wolff | 415/1 |
| 4,087,261 | 5/1978 | Hays | 60/649 |
| 4,141,219 | 2/1979 | Elliot | 60/645 |

FOREIGN PATENT DOCUMENTS

| | | | |
|---|---|---|---|
| 797106 | 4/1936 | France | 416/197 |

*Primary Examiner*—A. Michael Chambers
*Attorney, Agent, or Firm*—William W. Haefliger

[57] ABSTRACT

An improved scoop is usable in combination with a wheel providing a rotating peripheral surface with an annular body of liquid supported on that surface and rotating with the wheel. The improvement comprises:

(a) The scoop projects partially into the rotating annular body of liquid;

(b) The scoop is mounted for rotation about an axis and in a forward direction in response to force transmission to the scoop from liquid entering the scoop;

(c) The scoop has an interior surface that is locally curved to turn the entering liquid for discharge from the scoop in a relatively rearward direction; and (d) Substantially the entirety of the scoop interior rearwardly of said interior surface is rearwardly open to the exterior.

12 Claims, 4 Drawing Figures

2
20a
28
11a
10
22a
22
40
13
11
41
23
24
25
42
14
16
26
27
43
15
60
61
62
17
23
50
40
52
52
22b
18
31
19
30
29
45
28
20
21
12
44
2

SCOOP FOR REMOVING FLUID FROM ROTATING SURFACE OF TWO-PHASE REACTION TURBINE

BACKGROUND OF THE INVENTION

This invention relates generally to power generating equipment, and more particularly concerns the extraction of power from liquid forming on a rotating separator as a result of two-phase fluid discharge from nozzle means.

In U.S. Pat. Nos. 3,879,949 and 4,087,261 there are disclosed nozzles and separator wheels, the nozzles directing two-phase fluid jets toward the separator wheel on which a ring of liquid forms. The wheel and ring of liquid are rotated by such jets, and gas or vapor becomes separated from the liquid. To improve the efficiency of such devices, it is desirable to utilize the kinetic energy of the rotating ring of liquid that forms on the separator wheel. While removal of liquid from the rotating ring is described in U.S. Pat. No. 4,087,261, there is a need for apparatus which will efficiently remove liquid from the ring to produce power under conditions where the ring depth may vary or be varied.

SUMMARY OF THE INVENTION

It is a major object of the invention to provide method and apparatus to produce variable or controllable output power by utilization of kinetic energy in a rotating ring of liquid on a separator wheel, as referred to above. Fundamentally, the apparatus of the invention comprises:

(a) a scoop projecting partially into said rotating annular body of liquid, (b) means mounting the scoop for rotation about an axis and in a forward direction in response to force transmission to the scoop from liquid entering the scoop, (c) the scoop having an interior surface that is locally curved to turn the entering liquid for discharge from the scoop in a relatively rearward direction, (d) substantially the entirety of the scoop interior rearwardly of said interior surface being rearwardly open to the exterior, In this regard, means may be provided to control the depth of the liquid ring on the separator wheel, whereby the mass of liquid entering the scoop per unit of time is controlled, to achieve control of power output from a shaft or other structure rotated by the scoop. Since the scoop interior is rearwardly open to the exterior, the depth of liquid entering the scoop may be increased up to one-third the diameter of curved interior surface of the scoop, for power output control. Also, the scoop itself is insensitive, i.e. tolerant, to changes in entering liquid depth.

Further objects include the provision of scoop run-in and run-out surfaces extending flatly and tangentially relative to the entering flow and the 180° turned flow for efficient scoop operation; the scoop curved surface diameter is maximized—i.e. at between 3 and 10 times the entering liquid flow height or depth for efficient operation; provision of wake shedder structure associated with the scoop; and the employment of two or more scoops on the same output shaft.

In its basic method aspects, the invention contemplates the following steps:

(a) mounting the scoop to project into the rotating ring of liquid and so that the liquid enters the scoop, (b) turning said entering liquid in the scoop for discharge from the scoop, thereby causing the scoop to rotate, and (c) controlling the depth of the liquid entering the scoop.

These and other objects and advantages of the invention, as well as the details of an illustrative embodiment, will be more fully understood from the following description and drawings, in which:

DRAWING DESCRIPTION

DETAILED DESCRIPTION

Figure 1:
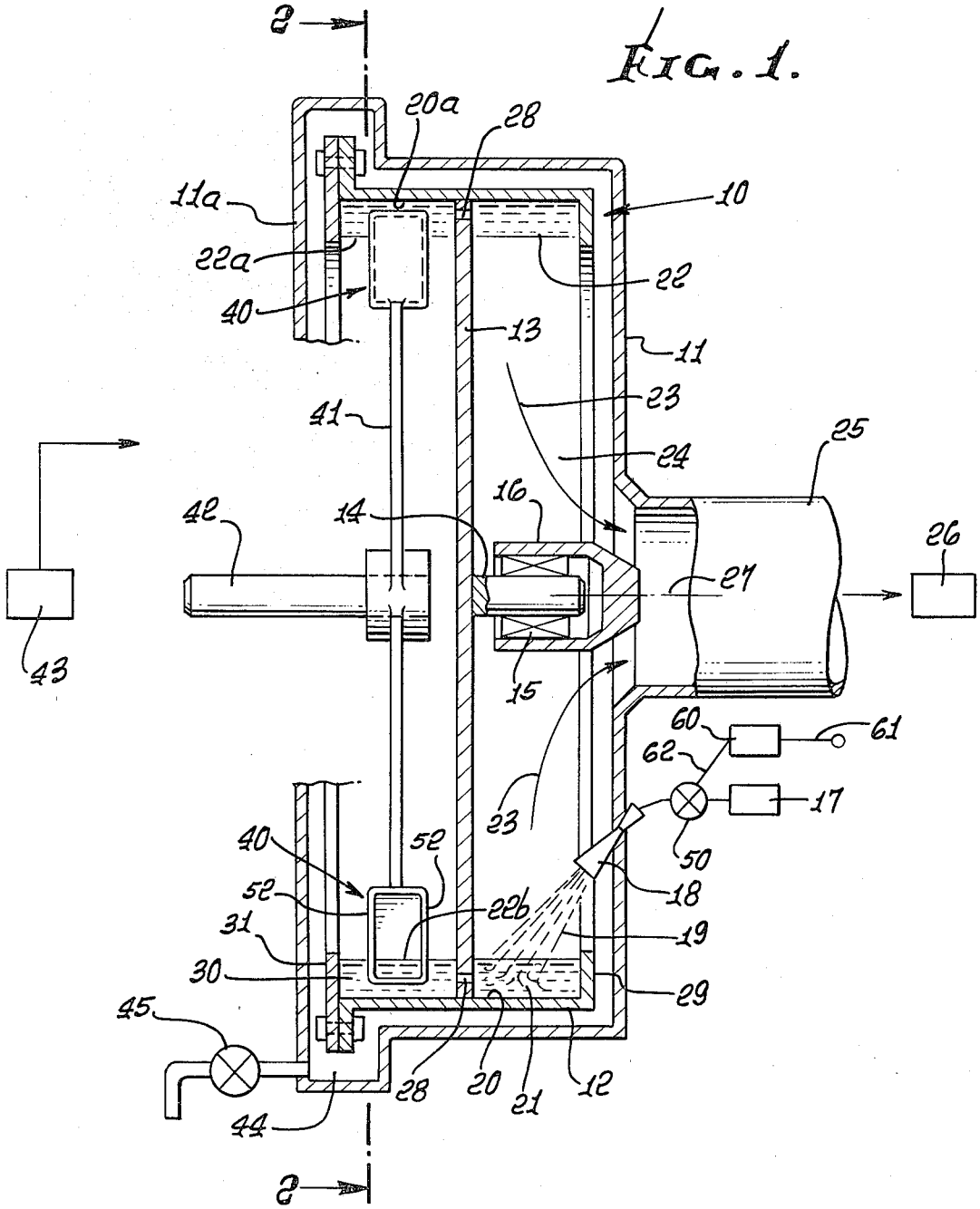
FIG. 1 is a sectional elevation showing two-phase separator apparatus employing a rotor and scoops of the invention.
Figure 2:
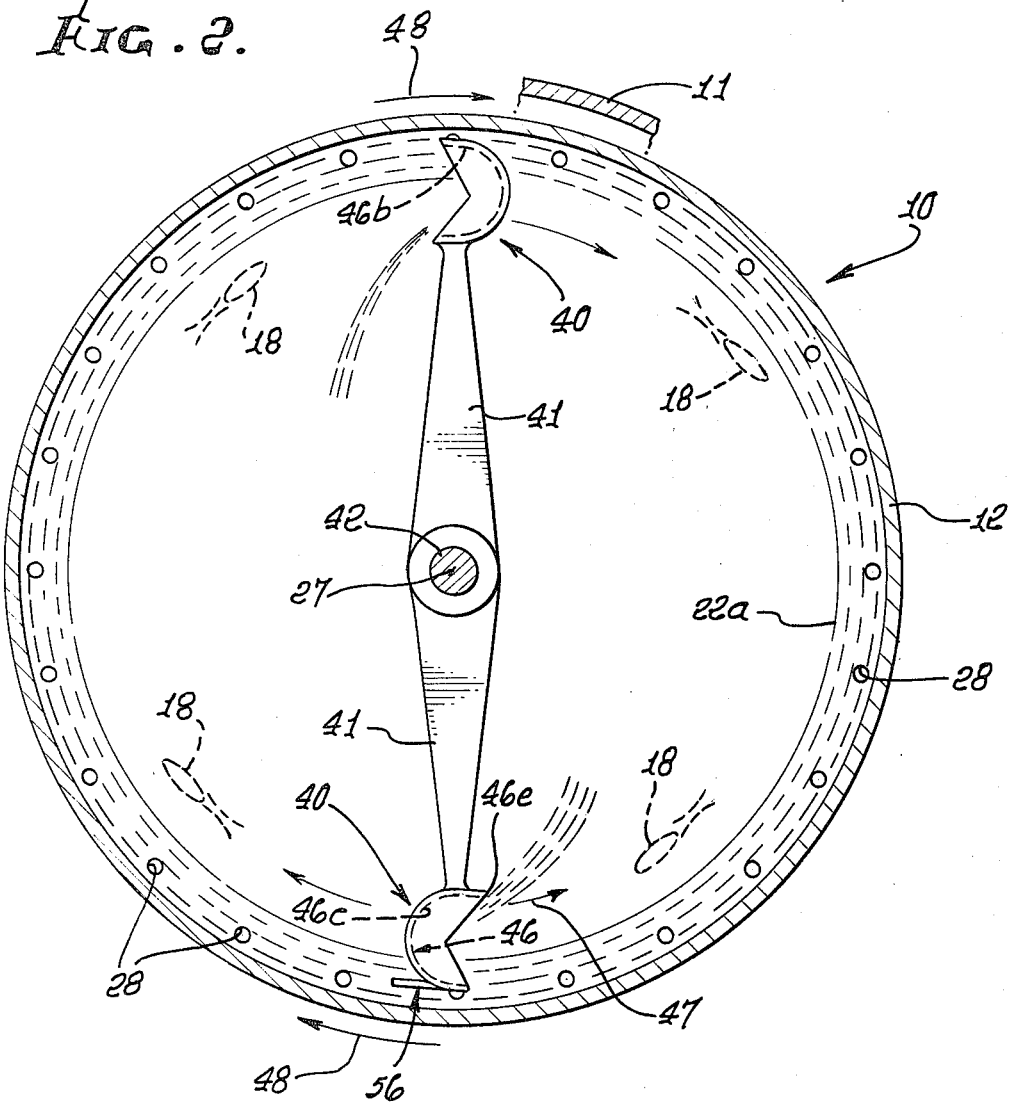
FIG. 2 is an end elevation taken on lines 2—2 of FIG. 1.

FIGS. 1 and 2 show a separator wheel 10 rotating within casing 11. The wheel may include an annulus 12 attached to radial plate member 13 supporting a stub axle 14. The latter is in turn supported for rotation by bearings 15 which are carried by fixed hub structure 16.

Working fluid is supplied at relatively high pressure from a source or sources 17 to nozzle means such as multiple nozzles 18. That fluid may for example include liquid and gas which mixes in the nozzles and exists therefrom at relatively low pressure. The resulting high-velocity two-phase jet or jets 19 impinge on the inner surface 20 of the separator annulus 12 or rim as at locations indicated at 21 in FIG. 1. FIG. 2 shows the nozzles extending with components in the direction of rotation of the wheel, the jets also having such components, to effect rotation of 12. The liquid (such as water, for example) becomes concentrated in an annular body or layer 22 on inner surface 20 due to the inertia of the liquid and to centrifugal force, whereas the gas phase separates and flows radially inwardly, as indicated by arrows 23. The gas (such as steam, for example) may be removed from the interior 24 of the casing as via a central pipe 25 or other porting, for employment as in driving a turbine indicated at 26. The axis of the apparatus appears at 27, and layer 22 is confined between wheel wall or flange 29 and plate member 13.

The liquid flows from the layer 22 through passages 28 in plate member 13 and then into annular zone 30 defined between plate number 13 and wheel wall or annular flange 31. As a result, another liquid body or layer **22*a* is formed in zone 30, and is held against surface 20*a* by centrifugal force acting on the rotating body 22*a***.

In accordance with the invention, at least one scoop 40 and typically two diametrically opposed, like scoops 40 are provided, each projecting partially into the rotating annular body of liquid **22*a*. Both scoops may have the same radial dimensions from axis 27, and rotate together. Means mounting the scoop or scoops may typically include a radially extending strut or struts 41 carried by an output shaft 42 to which torque is delivered via the scoops and struts. Equipment 43 driven by the shaft may include or comprise a motor, or generator, or pump, or other device. Shaft 42 is typically coaxial with separator axis 27. Housing structure 11***a* may extend about the scoops and flange 31. A sump 44 formed by structure 11*a* may receive and collect liquid such as water discharged from the scoop (as will be explained), and an outlet valve 45 drains liquid from the sump, as required.

Figure 3:
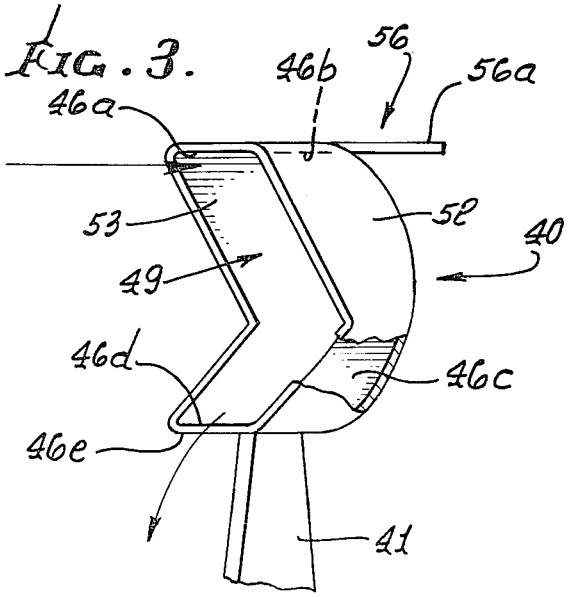
FIG. 3 is an enlarged perspective view of a scoop as also shown in FIGS. 1 and 2.

More specifically, and referring to FIGS. 2 and 3, each scoop 40 has an interior surface 46 that is curved to turn the "scooped" entering liquid for discharge from the scoop in a relatively rearward direction, indicated by arrow 47. Thus, in FIG. 2, as the separator annulus 12 and water or liquid body 22*a* are rotated clockwise forwardly, as shown by arrows 48, the water body enters each scoop as shown, and drives that scoop counterclockwise forwardly about axis 27 as the water in the scoop is turned to exit rearwardly in the direction of arrow 47.

It is important that substantially the entirety of the scoop interior 49 rearwardly of curved surface 46 be rearwardly open to the exterior as shown. This enables the scoop to "bite" into varying depths of annular water body 22*a* up to a level equal to about $\frac{2}{3}$ the radius "r" of the scoop curved wall 46. In this regard, the level or depth of the water body 22*a* can be varied or adjusted by varying or controlling the amount of fluid discharged by the nozzles 18 (see control valve 50 in FIG. 1), whereby the power output from the shaft 42 can be controlled.

The scoop interior surface has a first portion 46*a* that extends generally tangentially relative to the entering liquid, and forwardly from a scoop lip 46*a*, past or over which the liquid relatively enters the scoop. Surface 46*b* is flat and parallel to the liquid surface indicated at 22*b* in FIG. 1, and surface 46*b* serves as the "run-in". The entering flow cross section is generally rectangular, between radially spaced surfaces 46*b* and 22*b*, and laterally between scoop side walls 52 and 53.

Figure 4:
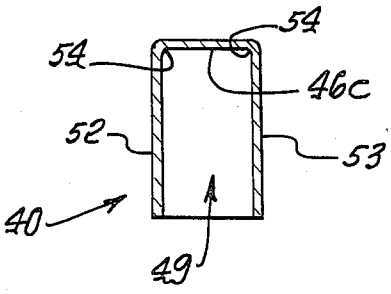
FIG. 4 is a fragmentary section taken through the scoop.

The scoop interior surface 46 has a second portion 46*c* which merges with surface first portion 46*b*, and then curves throughout approximately 180°. Note that surface portion 46*c* intersects the side walls 52 and 53 at locally rounded corners 54, in FIG. 4, whereby the approximate rectangular cross section of the liquid being turned 180° is maintained. The inner sides of laterally opposed walls 52 and 53 are normal to the curved interior surface 46*c*.

The scoop interior surface 46 also has a third portion 46*d* which merges with surface portion 46*c* at a location closer to axis 27 than said first portion 46*b*, the third portion 46*d* having a lip 46*e* past or over which the turned liquid leaves the scoop in a rearward direction indicated by arrow 47. Portions 46*b* and 46*d* extend in generally parallel relation.

In addition, the scoop may carry a surface 56*a* characterized as a "wake shedder" defined by a plate 56 projecting relatively forwardly from the scoop, as from its radially outermost extent as shown, to contact the annular body of liquid 22*a* for suppressing the formation of a wake in the liquid.

In operation, and by rotating at half the angular velocity of the oncoming liquid, liquid is removed by the scoop from the separator surface and turned 180° (with essentially zero residual kinetic energy and small change in radius ratio) to obtain maximum shaft power output. The optimal geometrical configuration and efficiency of the scoop is characterized by:

(a) $\frac{1}{2}$ full radius interior surface 46*c*

(b) aspect radio $=\frac{1}{2}$ of scoop entrance flow cross-section (c) scoop diameter $=3\rightarrow10$ times the entrance flow height (of entering liquid)

(d) run-in and run-out fixtures (46*a* and 46*e*)

(e) wake shedder (ventilation cut-out) plate 56

Items (a) and (b) are established by minimizing the relative wetted area for a free surface channel whose cross-sectional area varies with operating conditions. Item (c) is computed analytically as a function of scoop Reynolds number and length scale. In the analysis, the scoop diameter, D, is maximized relative to a fixed entrance liquid film thickness, Δ, up to the point where a coherent stream fails to exist throughout the scoop and a spray field ensues. The "run-in" is incorporated to prevent the oncoming flow from "spilling" over the side plates of the scoop whereas the "run-out" assurs that the exiting jet is aligned 180° from the entering jet.

Advantages of the scoop include:

(a) high efficiency, (b) insensitivity or tolerance to off-design operation, and (c) low external drag.

The high efficiency (less than 5% loss is kinetic energy, verified by experiment) is due to the mechanism by which the fluid enters the scoop rectilinearly at high kinetic energy, is simultaneously distorted into a curvilinear path and decelerated, which converts the kinetic energy to high average film pressure with low frictional losses, prior to being accelerated in a narrow region near the scoop exit plane as the average pressure returns to ambient.

The tolerance to off-design operation is due to the fact that the cross-sectional area of the flow through the scoop is controlled by a free (as opposed to solid) surface. This surface varies the film height in response to the flowrate through the system and velocity of the scoop relative to the separator film. With moderate departures from the design film height, variations in scoop performance are small.

Only the external drag on the scoop is a source of deceleration of the rotating separator rim. Although this drag increases rotor torque, it must be added to the system by the two-phase flow which is sustaining the separator rotation, at considerable expense of energy. Therefore, the rounded corners and small relative scale of the scoop, combined with an optimum placement of the scoop with respect to the separator solid surface result in low external drag forces.

Referring back to FIG. 1, a feed-back control and valve driver 60 may be connected at 61 to drive equipment 43, and at 62 to valve 50, to control that valve via which fluid is supplied to the nozzle or nozzles. Thus, the level or depth of liquid entering the scoop or scoops may be controlled (thereby to control power output from the rotating scoops and delivered to shaft 42) in response to conditions at equipment 43. For example, the power output to the equipment may be controlled to be constant or near constant, in that an incremental increase in power delivery would cause the valve to incrementally reduce fluid supply to the nozzles, and vice versa. Control 61 may be set to any desired power delivery level, and the scoop configuration allows different depths of liquid entry to accumulate such different power levels.

We claim:

1. In combination with a wheel providing a rotating peripheral surface with an annular body of liquid supported on said surface and rotating with the wheel, the improvement comprising (a) a scoop projecting partially into said rotating annular body of liquid, (b) means mounting the scoop for rotation about an axis and concentrically with said annular body of liquid, and in a forward direction in response to force transmission to the scoop from liquid entering the scoop, (c) the scoop having an interior surface to turn the entering liquid for discharge from the scoop in a relatively rearward direction, (d) substantially, the entirety of the scoop interior rearwardly of said interior surface being rearwardly open to the exterior, (e) the scoop interior surface having a lip and a "run-in" first portion that extends generally tangentially and flatly relative to the entering liquid and forwardly from said lip past which the liquid relatively enters the scoop, (f) the scoop interior surface having a second portion which merges with said first portion and then locally curves throughout approximately 180°, (g) the scoop interior surface having a "run-out" third portion which extends flatly and substantially parallel to said first portion, and merges with said curved second portion at a location closer to said axis than said first portion, said third portion having a lip past which the liquid relatively leaves the scoop in said rearward direction, (h) the scoop having laterally opposed, generally parallel side walls extending at substantially 90° to said first and third portions of the scoop interior surface.

2. The improvement of claim 1 wherein said side wall inner sides merge with said curved interior surface, said inner sides extending generally normal to said curved interior surface.

3. The improvement of claim 1 including a second scoop like said first mentioned scoop, and there being means mounting the second scoop to have the same radial dimensions from said axis as said first mentioned scoop, and to rotate with said first mentioned scoop.

4. The improvement of claim 1 including equipment operatively connected with said scoop to be driven in rotation thereby.

5. The improvement of claim 4 wherein said equipment includes a pump.

6. The improvement of claim 4 wherein said equipment includes a motor.

7. The improvement of claim 4 wherein said equipment includes an electrical generator.

8. The improvement of claim 4 including means to control the radial thickness of the liquid entering the scoop in response to changes in the power supplied to said equipment by rotation of the scoop.

9. The improvement of claim 1 including nozzle means via which two-phase fluid is directed to effect collection of said liquid body on said wheel surface.

10. The improvement of claim 1 including means to control the depth of the liquid body on said wheel surface and which enters the scoop, whereby power delivered via the rotating scoop may be controlled.

11. The improvement of claim 1 wherein the diameter of said scoop curved surface is between 3 and 10 times the depth of liquid entering the scoop.

12. For use in combination with a wheel providing a rotating peripheral surface with an annular body of liquid supported on said surface and rotating with the wheel, the improvement comprising (a) a scoop projecting partially into said rotating annular body of liquid, (b) means mounting the scoop for rotation about an axis and in a forward direction in response to force transmission to the scoop from liquid entering the scoop, (c) the scoop having an interior surface that is locally curved to turn the entering liquid for discharge from the scoop in a relatively rearward direction, (d) substantially the entirety of the scoop interior rearwardly of said interior surface being rearwardly open to the exterior, (e) and including a surface carried by and projecting from the scoop in said forward direction for contact with the annular body of liquid to suppress the formation of a liquid wake in said liquid.

* * * * *